US009705249B2

(12) United States Patent
Horiuchi

(10) Patent No.: US 9,705,249 B2
(45) **Date of Patent: *Jul. 11, 2017**

(54) CONNECTOR

(71) Applicant: Sumitomo Wiring Systems, Ltd., Yokkaichi, Mie (JP)

(72) Inventor: Hidefumi Horiuchi, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/715,826

(22) Filed: May 19, 2015

(65) Prior Publication Data

US 2015/0349458 A1 Dec. 3, 2015

(30) Foreign Application Priority Data

May 27, 2014 (JP) ..... 2014-109180

(51) Int. Cl.

| | |
|---|---|
| ***H01R 13/627*** | (2006.01) |
| ***H01R 13/629*** | (2006.01) |
| ***H01R 13/639*** | (2006.01) |
| *H01R 13/64* | (2006.01) |

(52) U.S. Cl.

CPC ..... *H01R 13/629* (2013.01); *H01R 13/6272* (2013.01); *H01R 13/62955* (2013.01); *H01R 13/639* (2013.01); *H01R 13/64* (2013.01)

(58) Field of Classification Search

CPC ..... H01R 13/6275; H01R 13/6272; H01R 13/62955; H01R 13/629; H01R 13/639; H01R 13/64

USPC ..... 439/352, 489

See application file for complete search history.

(56) References Cited

U.S. PATENT DOCUMENTS

| | | | | |
|---|---|---|---|---|
| 5,848,912 | A * | 12/1998 | Okabe | H01R 13/6275 439/352 |
| 6,524,125 | B2 * | 2/2003 | Nakamura | H01R 13/6272 439/352 |
| 6,544,066 | B2 * | 4/2003 | Fukase | H01R 13/6272 439/352 |
| 9,431,777 | B2 * | 8/2016 | Horiuchi | H01R 13/6272 |

FOREIGN PATENT DOCUMENTS

| | | |
|---|---|---|
| JP | 2000-068003 | 3/2000 |

* cited by examiner

*Primary Examiner* — Felix O Figueroa
(74) *Attorney, Agent, or Firm* — Gerald E. Hespos; Michael J. Porco; Matthew T. Hespos

(57) ABSTRACT

A connector includes a first housing (10) with a lock arm (32), a second housing (40) with a lock (42) is connectable to the first housing (10), and a detector (60) is mounted movably on the first housing (10). The lock (42) includes a standing wall (43) extending along a direction intersecting a connecting direction of the first and second housings (10, 40). A locking area (48) to be locked by the lock arm (32) when the first and second housings (10, 40) are connected properly is provided on one wall surface of the standing wall (43) and a pressing area (44) for pressing the detector (60) in the process of connecting the first and second housings (10, 40) is provided on another wall surface of the standing wall (43).

13 Claims, 15 Drawing Sheets

CONNECTOR

BACKGROUND

1. Field of the Invention

The invention relates to a connector.

2. Description of the Related Art

Japanese Unexamined Patent Publication No. 2000-68003 discloses a connector with a connection detecting function. The connector includes male and female housings that connectable to each other. A spring holder is mounted movably on the female housing and coil springs are mounted on opposite left and right sides of the spring holder. The female housing includes a deflectable lock arm. Further, the male housing includes a locking protrusion and left and right ribs at opposite sides of the locking protrusion.

The coil springs accommodated in the spring accommodating portions of the spring holder contact ribs on the male housing in the process of connecting the two housings and are pressed by the ribs to compress gradually as the connection proceeds. If a connecting operation of the two housings is stopped halfway, the coil springs release biasing forces accumulated thus far to separate the male housing from the female housing. Thus, the two housings are not left in an incompletely connected state. On the other hand, when the two housings are connected properly, a lock arm on the female housing resiliently locks the male housing to hold the two housings in a connected state.

The male housing of the connector disclosed in Japanese Unexamined Patent Publication No. 2000-68003 requires the dedicated ribs for compressing the coil springs. Thus, a general-purpose male housing with no ribs cannot be used.

The invention was completed based on the above situation and aims to improve the versatility of a connector with a connection detecting function.

SUMMARY

The invention relates to a connector with first and second housings that are connectable to one another. The first housing includes a lock arm and the second housing includes at least one lock that is connectable to the first housing. At least one detector is mounted movably on the first housing. The detector is configured to be pressed and moved by the second housing in the process of connecting the first and second housings. The lock is locked to the lock arm to hold the first and second housings in a connected state when the first and second housings are connected properly. The lock includes at least one standing wall extending along a direction intersecting a connecting direction of the first and second housings. A locking area is provided on one wall surface of the standing wall and is to be locked by the lock arm when the first and second housings are connected properly. A pressing area is provided on another wall surface of the standing wall for pressing the detector in the process of connecting the first and second housings.

A reaction force generation member may be provided in or on the detector for separating the second housing from the first housing when a connecting operation of the first and second housings is stopped at an intermediate stage.

The reaction force generation member may comprise a resilient member configured to assist separation forces of the first and second housings.

The first housing may include a housing main body configured to define a deflection space for the lock arm between a lock piece of the lock arm and the housing main body, and the resilient member may be arranged between the lock piece and the housing main body at least before the detector is moved.

The lock may include at least one guide wall projecting from the other wall surface of the standing wall and two of the pressing areas may be arranged at opposite sides of the guide wall on the other wall surface of the standing wall. The disposition of the pressing areas at the opposite sides of the guide wall ensures that the detector is pressed by both pressing areas and is moved in a well-balanced manner.

A recess may be provided in an intermediate part of the detector in a width direction perpendicular to a moving direction of the detector.

The standing wall may be fit into the recess and the pressing area may contact a back surface of the recess when the detector is moved in the process of connecting the first and second housings. Thus, the detector is moved in a well-balanced manner without being displaced between the pressing areas.

The detector may integrally or unitarily include at least one resilient arm configured to slide on at least one guiding surface provided in one of the first and second housings and to deflect in a direction intersecting a connecting direction of the first and second housings in the process of connecting the first and second housings. A restoring force of the deflected resilient arm applies a separation force between the first and second housings in a direction to separate the first and second housings from each other The guiding surface may be provided in the first housing and may define a slant for deflecting and deforming the resilient arm inward of the first housing.

The detector may include at least one regulating portion configured to regulate the deflection and deformation of the lock arm in a direction to release a locked state to the second housing by contacting the lock arm when the first and second housings are connected properly.

The standing wall of the lock has an additional function of pressing the detector. Thus, it is not necessary to provide the second housing with a dedicated rib or the like for pressing the detector and an existing connector housing can be used as the second housing without revision. As a result, the versatility of the connector is improved.

These and other features of the invention will become more apparent upon reading the following detailed description of preferred embodiments and accompanying drawings. It should be understood that even though embodiments are described separately, single features thereof may be combined to additional embodiments.

DETAILED DESCRIPTION

Figure 14:
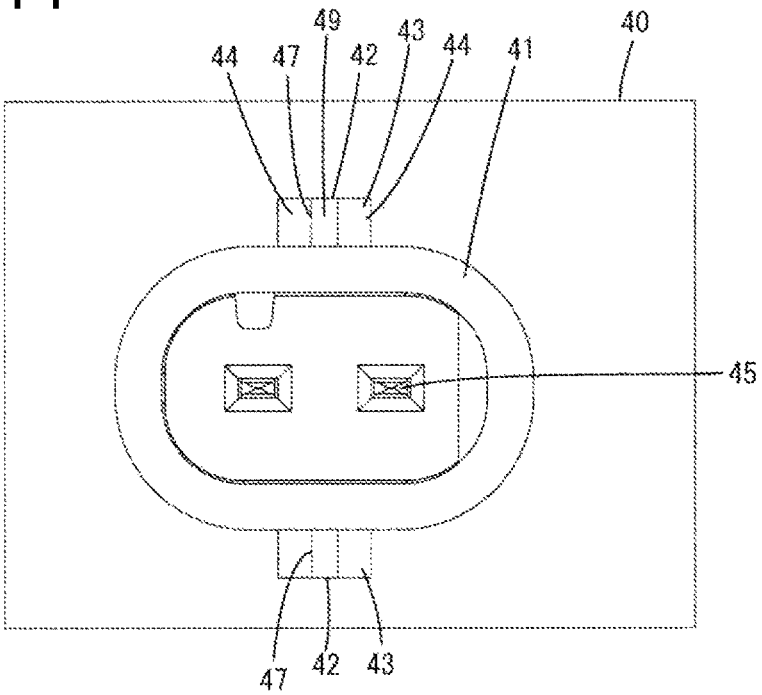
FIG. 14 is a front view of the second housing.

An embodiment of the invention is described with reference to the drawings. A connector in accordance with an embodiment of the invention includes a first housing 10 and a second housing 40 that are connectable to each other. A detector 60 is mounted movably on the first housing 10, and a torsion spring 90, as a resilient member, is mounted in the first housing. In the following description, ends of the first and second housings 10, 40 facing each other when a connecting operation is started are referred to as the front ends concerning a front-back direction. A vertical direction is based on FIGS. 5 to 8, 11, 12, 14, 15 and 17, and a width direction is synonymous with a lateral direction of FIGS. 11 and 14.

The second housing 40 is made of synthetic resin and is configured as a general-purpose male connector housing to be coupled to an unillustrated device. As shown in FIGS. 14 to 17, the second housing 40 includes a forwardly open tubular receptacle 41, and tabs 46 of male terminal fittings 45 project in the receptacle 41. A lock 42 projects in a widthwise central part of the upper surface of the receptacle 41.

Figure 15:
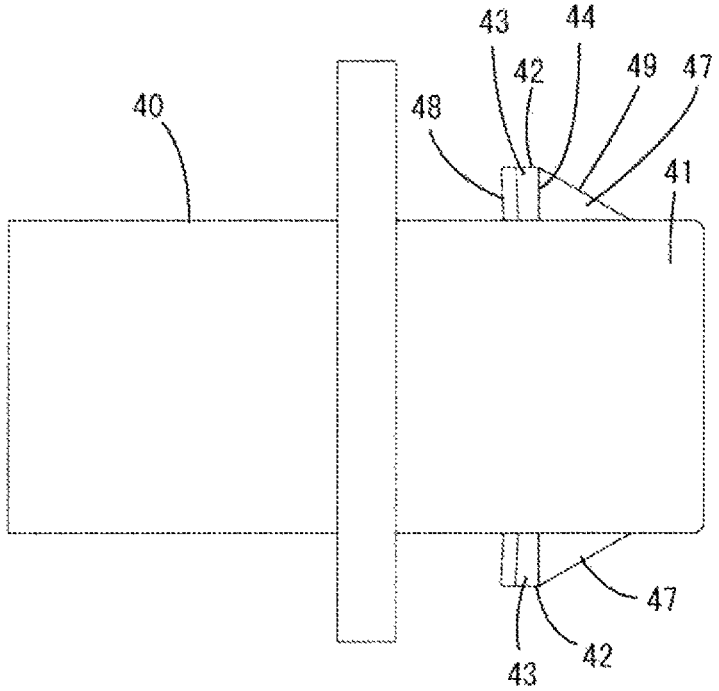
FIG. 15 is a side view of the second housing.
Figure 16:
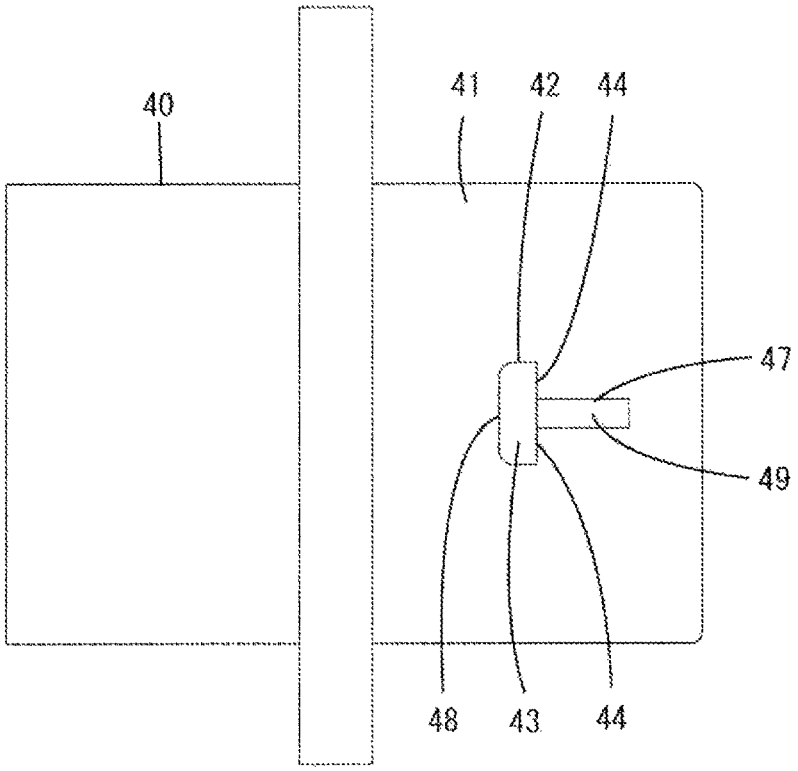
FIG. 16 is a plan view of the second housing.

As shown in FIGS. 14 to 17, the lock 42 has a standing wall 43 extending along the width direction (direction perpendicular to a connecting direction of the first and second housings 10, 40) and a guide wall 47 extending forward along the front-back direction (connecting direction of the first and second housings 10, 40) from the front surface of the standing wall 43 in the connecting direction of the second housing 40. As shown in FIG. 16, the lock portion 42 is substantially T-shaped in a plan view.

Figure 17:
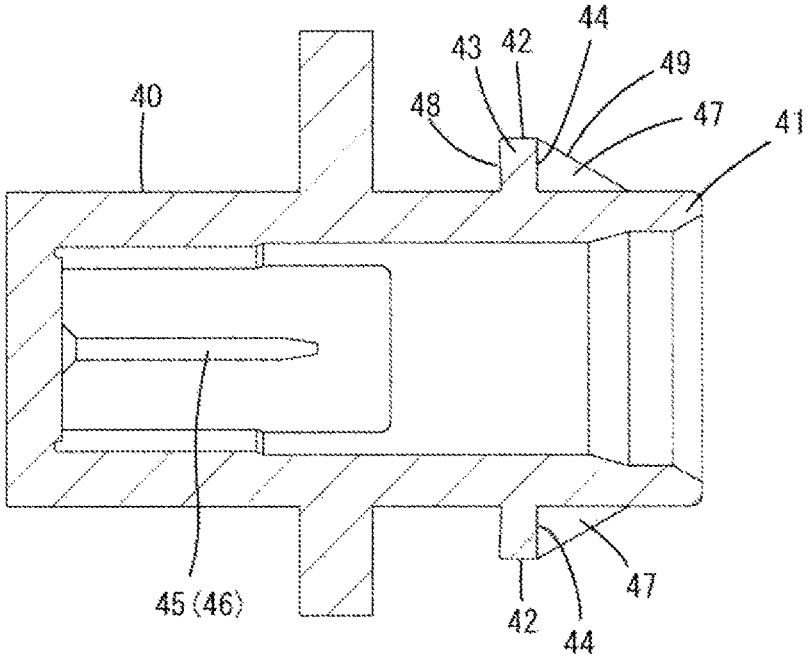
FIG. 17 is a side view in section of the second housing.

The standing wall 43 is in the form of a rectangular plate when viewed from behind. As shown in FIGS. 15 and 17, the rear surface of the standing wall 43 in the connecting direction of the second housing 40 is somewhat inclined toward the upper projecting end. A locking area 48 lockable to a later-described lock arm 32 of the first housing 10 is provided over substantially the entire rear surface of the standing wall 43.

As shown in FIGS. 15 to 17, the front surface of the standing wall 43 is arranged upright substantially along the vertical direction. Two pressing areas 44 are provided at opposite widthwise sides of the guide wall 47 on the front surface of the standing wall 43 for pressing later-described pressed areas of the detector 60. Note that a lock 42 having the same shape as the above one also is provided in a widthwise central part of the lower surface of the receptacle 41.

As shown in FIGS. 15 and 17, the guide wall 47 is in the form of a right-angled triangular plate in a side view. The front edge of the guide wall 47 is a tapering inclined surface 49 inclined up toward the rear side. The upper end of the inclined surface 49 reaches the upper end of the standing wall 43. The inclined surface 49 of the guide wall 47 guides the deflection of a lock arm on a mating female connector housing in another use mode that includes no detector 60 of this embodiment.

Figure 5:
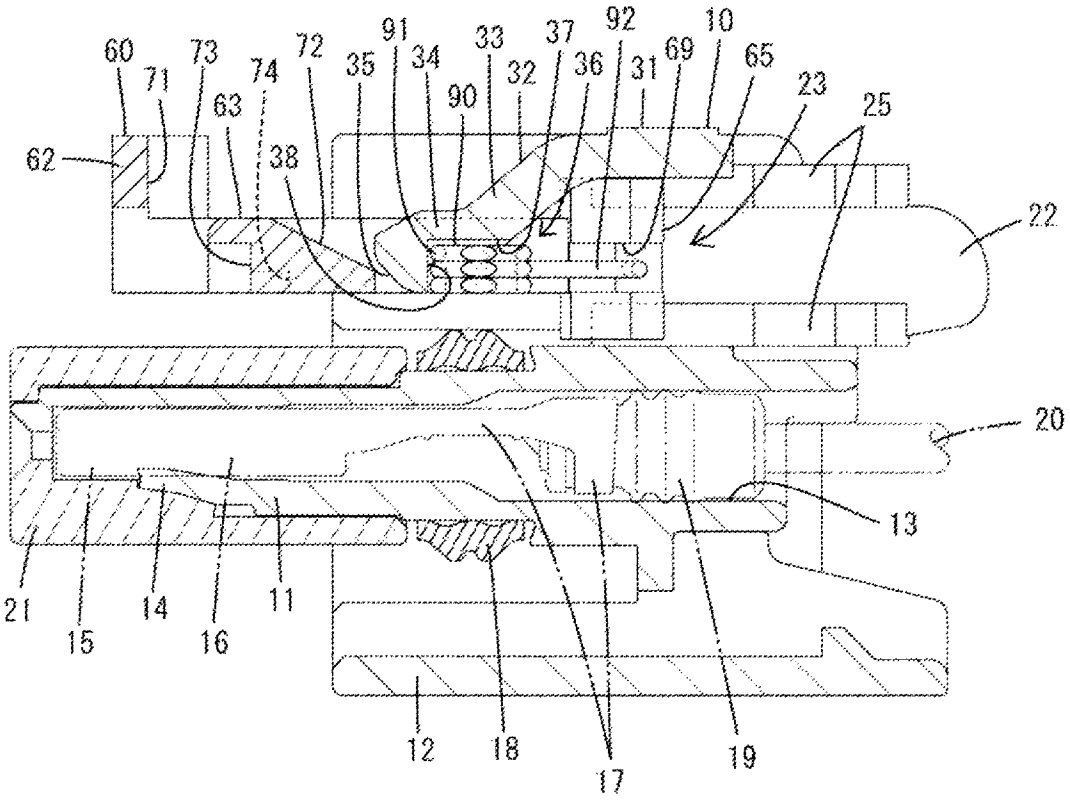
FIG. 5 is a side view in section showing a state of FIG. 1.
Figure 8:
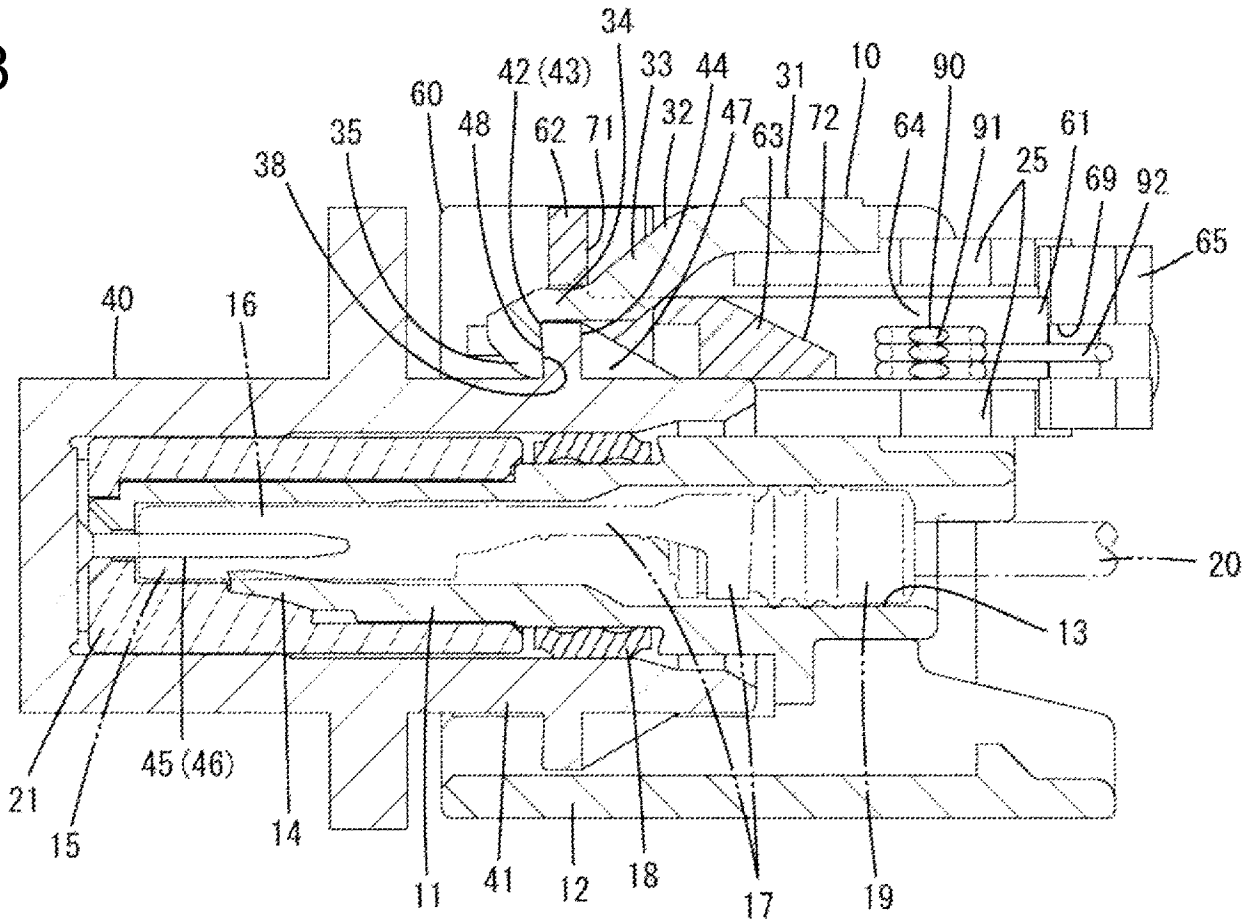
FIG. 8 is a side view in section showing a state of FIG. 4.

The first housing 10 is made of synthetic resin and includes, as shown in FIG. 5, a block-like housing main body 11 and a fitting tube 12 surrounding a rear end of the housing main body 11. As shown in FIG. 8, the receptacle 41 of the second housing 40 is fit between the housing main body 11 and the fitting tube 12 when the first and second housings 10, 40 are connected.

The housing main body 11 includes a plurality of cavities 13. In this embodiment, two cavities 13 are arranged in parallel in the width direction. As shown in FIG. 5, a locking lance 14 projects forward from the lower surface of the inner wall of each cavity 13. A female terminal fitting 15 is inserted into each cavity 13 from behind.

The female terminal fitting 15 is shown in FIG. 5 and is formed by bending an electrically conductive metal plate that is long and narrow in the front-back direction. The female terminal fitting 15 includes a tubular main body 16 and a barrel 17 located behind the main body 16 is be crimp connected to a core of a wire 20 and a rubber plug 19 fit on the wire 20. As shown in FIG. 8, the tab 46 of the male terminal fitting 45 is inserted and connected to the main body 16 when the first and second housings 10, 40 are connected properly. The locking lance 14 is locked to the main body 16 to hold the properly inserted female terminal fitting 15 in the cavity 13.

A seal ring 18 is mounted on the outer peripheral surface of the housing main body 11, as shown in FIG. 5, and is sandwiched resiliently between the receptacle 41 and the housing main body 11 when the first and second housings 10, 40 are connected properly, as shown in FIG. 8. In this way, a clearance between the first and second housings 10, 40 is sealed in a liquid-tight manner. A front retainer 21 is mounted into the housing main body 11 from the front and regulates deflection of the locking lances 14 for reliably retaining the female terminal fittings 15. Further, the properly mounted front retainer 21 prevents a forward detachment of the seal ring 18.

Figure 1:
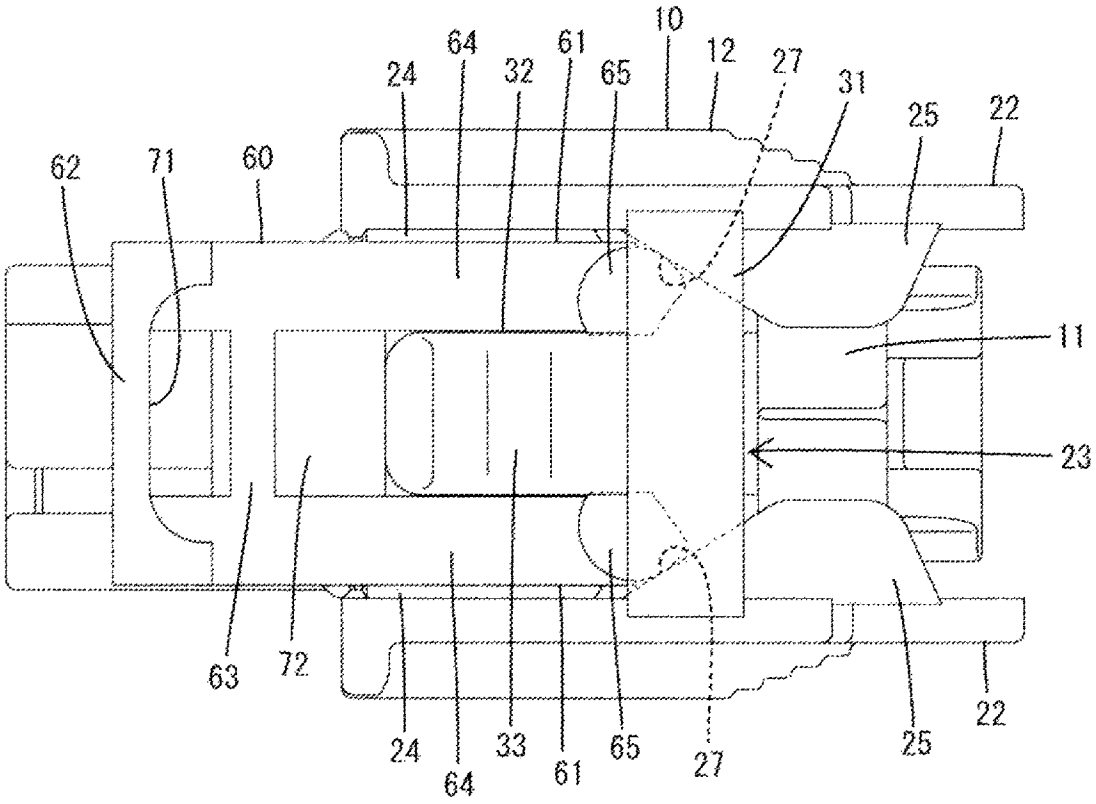
FIG. 1 is a plan view showing a state where a detector is assembled at a standby position on a first housing in a connector according to an embodiment of the invention.
Figure 9:
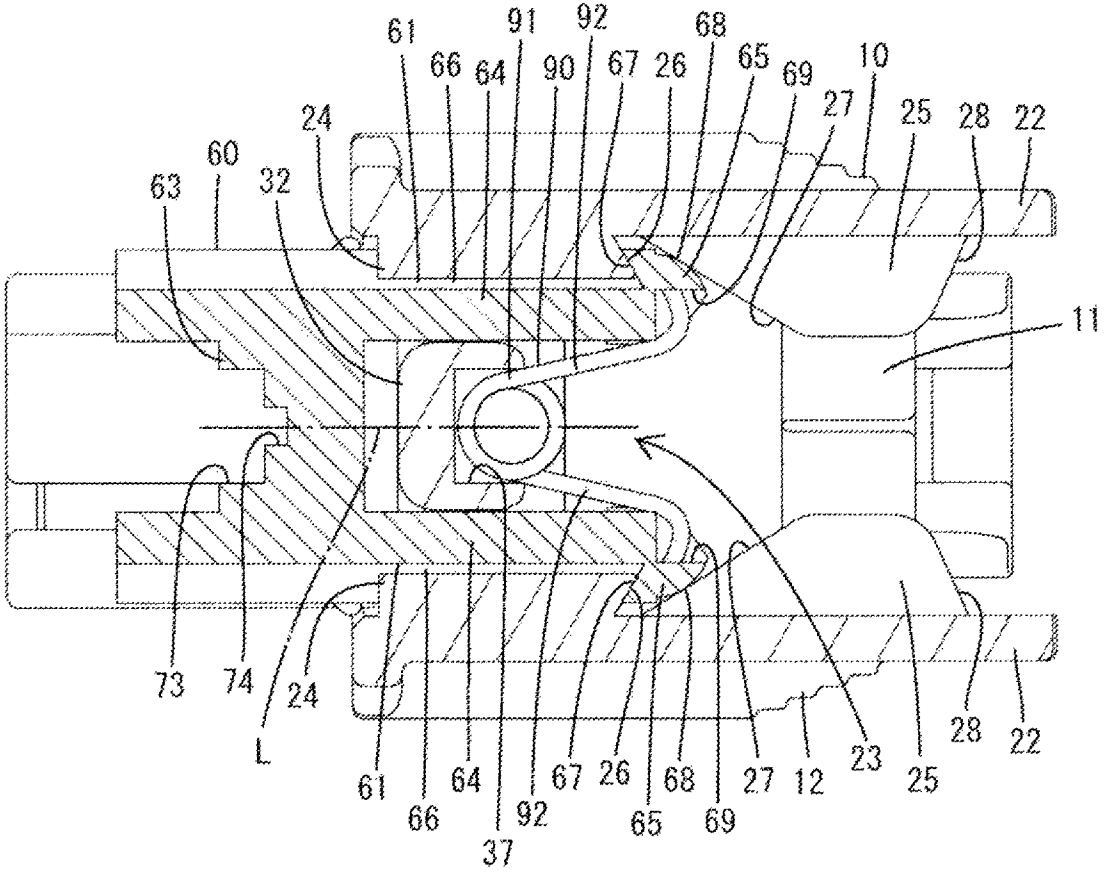
FIG. 9 is a plan view in section showing the state of FIG. 1.

As shown in FIGS. 1 and 9, two protection walls 22 are provided at the top of the fitting tube 12 and are spaced from each other in the width direction. Further, the both protection walls 22 are arranged substantially along the front-back direction. A mounting area 23 is defined between the protection walls 22 for receiving the detector 60.

Figure 10:
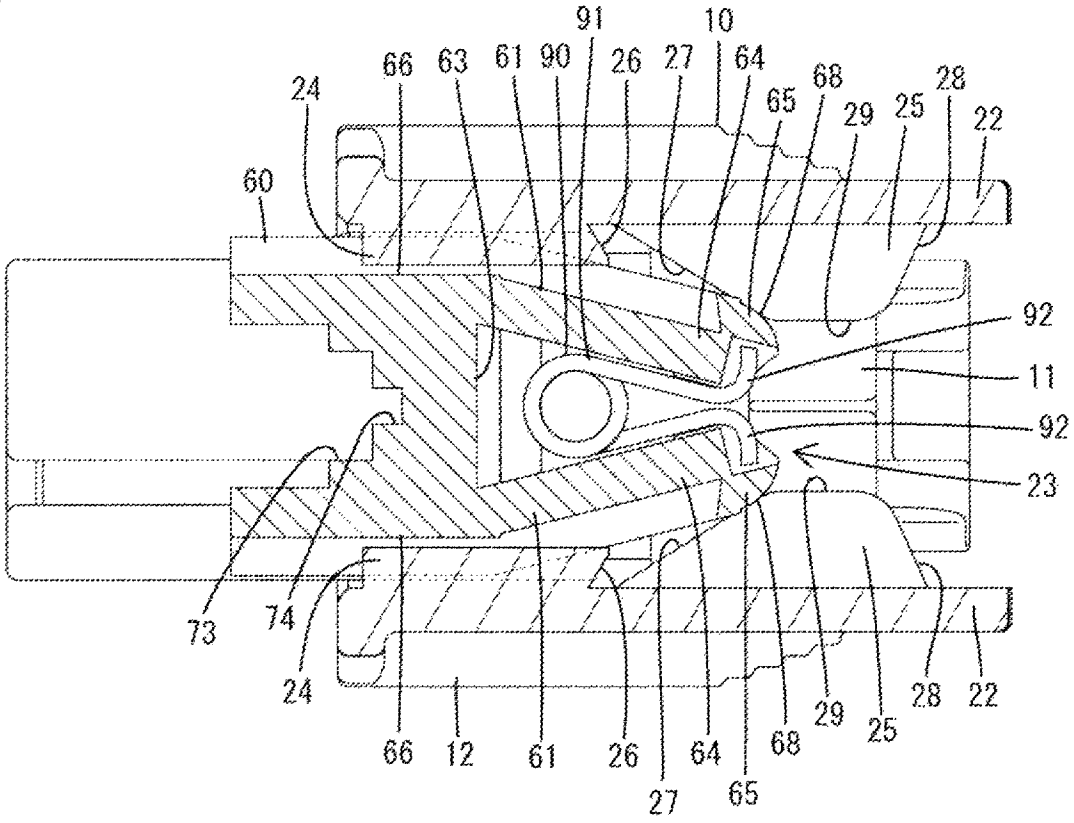
FIG. 10 is a plan view in section showing the state of FIG. 3 with the second housing omitted.

As shown in FIGS. 9 and 10, guide ribs 24 are provided on the inner surfaces of front ends of the protection walls 22 and extend in the front-back direction. Each guide rib 24 has a rectangular cross-section and is arranged slightly below a center of the protection wall 22 in a height direction. The rear end of each guide rib 24 is tapered reversely to define a stopper end 26 inclined forward toward a widthwise outer side.

Two guides 25 are provided behind the guide rib 24 on the inner surface of each protection wall 22 and spaced apart in the height direction. The front end of the guiding portion 25 defines a tapering front slant 27 (guiding surface) inclined back toward a widthwise inner side. The rear end of the guide 25 is formed into a tapering rear slant 28 inclined forward at a steeper angle than the front slant 27 toward the widthwise inner side. Further, a part of an end edge of the guide 25 between the front slant 27 and the rear slant 28 is formed into a straight surface 29 extending along the front-back direction.

As shown in FIG. 1, a bridge 31 extends between the upper ends of the protection walls 22 in the width direction.

The bridge 31 is in the form of a strip plate and is at a position overlapping with front ends of the guides 25 in the front-back direction. The lock arm 32 projects in a widthwise central part of the bridge 31. As shown in FIG. 5, the lock arm 32 includes a lock piece 33 in the form of a strip plate extending obliquely to a front lower side toward the housing main body 11 after extending forward substantially horizontally from the front end of the bridge 31 and further extending substantially horizontally at a front portion 34. The front portion 34 of the lock piece 33 includes a rib-like lock projection 35 extending in the width direction and projecting down. The lock arm 32 is deflectable and deformable in directions to move the lock piece 33 up and down with the front end of the bridge 31 of the lock piece 33 as a support. A deflection space 36 for allowing the deflection of the lock piece 33 is secured between the lock piece 33 and the housing main body 11. Further, a part of the lock arm 32 from the front end 34 of the lock piece 33 to the lock projection 35 is provided with a fitting recess 37 that opens down and back. A coil 91 (to be described later) of the torsion spring 90 can fit into the fitting recess 37. Further, the back surface of the fitting recess 37, which is the rear surface of the lock projection 35, is formed into a lock receiving surface 38 lockable to the locking area 48 of the standing wall 43 of the lock 42.

Figure 11:
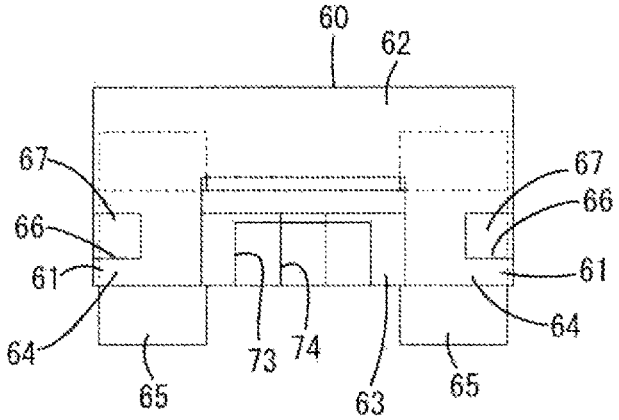
FIG. 11 is a front view of the detector.
Figure 12:
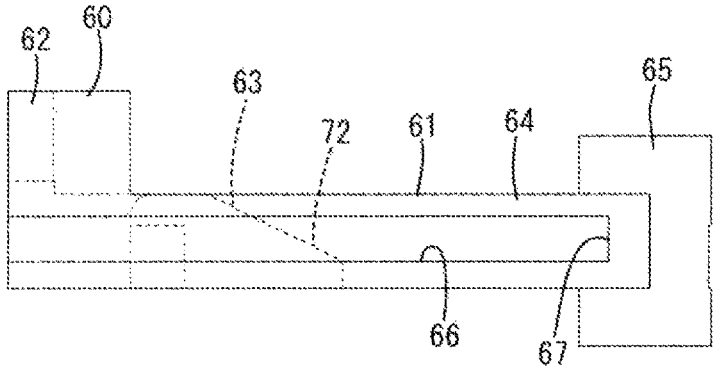
FIG. 12 is a side view of the detector.
Figure 13:
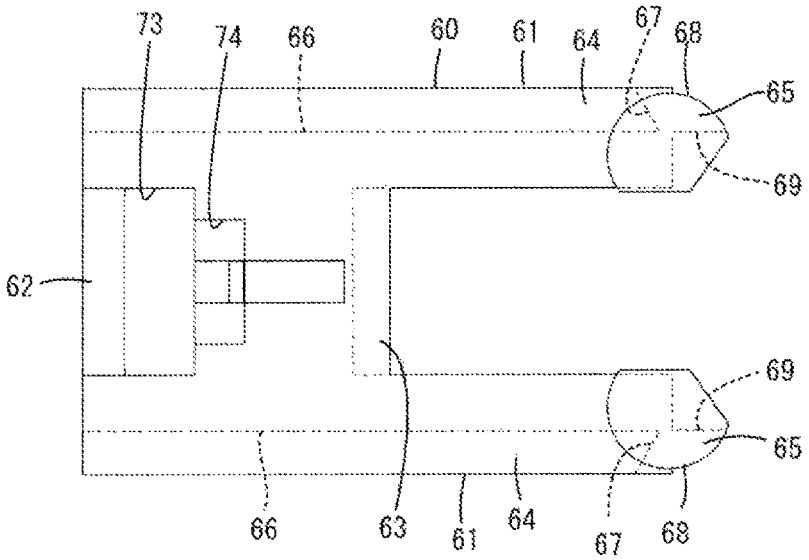
FIG. 13 is a bottom view of the detector.

The detector 60 is made of synthetic resin and has two parallel resilient arms 61 extending in the front-back direction. A regulating portion 62 extends in the width direction and couples the front ends of the resilient arms 61. An engaging portion 63 also extends in the width direction and couples intermediate parts of the resilient arms 61, as shown in FIGS. 11 to 13. The detector 60 is movable to a standby position (see FIGS. 1, 2, 5, 6 and 9) and a detection position (see FIGS. 4 and 8) located behind the standby position with respect to the first housing 10 when in the mounting area 23 of the first housing 10.

As shown in FIGS. 12 and 13, the resilient arm 61 has an arm main body 64 in the form of a rectangular column long and narrow in the front-back direction. A sliding portion 65 is connected to the rear end of the arm main body 64 and projects both up and down. As shown in FIG. 12, the resilient arm 61 is substantially T-shaped in a side view.

As shown in FIG. 10, both arm main bodies 64 are deflectable and deformable inwardly (toward a center axis of the first housing 10 to be described later) with parts thereof coupled to the engaging portion 63 as supports. As shown in FIGS. 11 and 12, forwardly open guide grooves 66 are provided on outer side surfaces of the arm main bodies 64 and extend in the front-back direction. The guide ribs 24 fit in the guide grooves 66 when the detector 60 is mounted into the mounting area 23 of the first housing 10, as shown in FIG. 9. The rear end of each guide groove 66 is formed into a stopper receiving portion 67 inclined forward toward a radially outer side. The stopper receiving portion 67 is formed by cutting the sliding portion 65. As shown in FIG. 9, the stopper receiving portion 67 can come into contact with the stopper end 26 of the first housing 10.

As shown in FIG. 13, an arcuate curved surface 68 is provided on a range of the outer side surface of the sliding portion 65 from a front side to the rear surface. The curved surface 68 can slide on the slant 27 of the guiding portion 25 when the detector 60 is moved. A front side of an inner side surface of the sliding portion 65 is recessed to form a receiving portion 69. As shown in FIG. 9, the receiving portion 69 has a substantially L-shaped cross-section. The back end of the receiving portion 69 defines the front end of the arm main body 64. A spring end portion 92 (to be described later) of the torsion spring 90 can be moved into and locked to the receiving portion 69.

The regulating portion 62 is coupled to the upper surfaces of the front ends of the both arm main bodies 64 and extends slightly higher than the arm main bodies 64, as shown in FIGS. 11 and 12. An escaping recess 71 is provided on the rear surface of the regulating portion 62, as shown in FIG. 1. The regulating portion 62 can regulate deflection of the lock arm 32 at the detection position, as shown in FIG. 8. Further, the lock piece 33 of the lock arm 32 can enter the escaping recess 71 of the regulating portion 62 at the detection position.

As shown in FIGS. 11 to 13, the engaging portion 63 bridges between the inner side surfaces of the arm main bodies 64 in a height range of the arm main bodies 64. The lower surface of the engaging portion 63 is continuous and flush with those of the arm main bodies 64 and the upper surface of the engaging portion 63 is continuous and flush with those of the arm main bodies 64. As shown in FIG. 5, the rear surface of the engaging portion 63 defines a tapered guiding slant 72 inclined up from the front end to the rear end.

As shown in FIG. 13, a recess 73 is open on the lower surface at a widthwise central part of the front surface of the engaging portion 63, and a deep recess 74 is provided in a widthwise central part of the back surface of the recess 73. Thus, as shown in FIG. 9, the engaging portion 63 becomes deeper in a stepped manner from the front surface thereof to the recess 73 and further to the deep recess 74. The standing wall 43 is insertable into the recess 73 (see FIG. 6) and the guide wall 47 is insertable into the deep recess 74.

As shown in FIG. 9, a single torsion spring 90 is mounted between the resilient arms 61 for one connector. The torsion spring 90 is of a known form and has cylindrical coil 91 formed by winding a wire material and two spring ends 92 extending from the coil 91. The axis of the coil 91 is aligned vertically when the torsion spring 90 is mounted between the resilient arms 61 and the spring ends 92 face each other while gradually being spaced farther apart toward the rear. As shown in FIG. 9, the torsion spring 90 is mounted in a widthwise central part of the first housing 10. Further, the resilient arms 61 and the guiding portions 25 are arranged symmetrically with respect to a center axis L1 passing through the widthwise central part of the first housing 10.

The detector 60 is inserted into the mounting area 23 of the first housing 10 from behind. The guide ribs 24 of the first housing 10 slide in the guide grooves 66 of the detector 60 during the inserting process to guide a movement of the detector 60.

The stopper receiving portions 67 of the resilient arms 61 are in contact with the stopper ends 26 of the corresponding guide ribs 24 when the detector 60 is at the standby position to regulate any further forward movement of the detector 60, as shown in FIG. 9. Further, the curved surfaces 68 of the sliding portions 65 of the detector 60 are in contact with the slants 27 of the guiding portions 25 of the first housing 10 when the detector 60 is at the standby position, thereby regulating a backward movement of the detector 60 toward the detection position.

The torsion spring 90 is mounted between the resilient arms 61 of the detector 60 before or after the detector 60 is assembled. As shown in FIG. 9, the coil 91 of the torsion spring 90 is inserted into the fitting recess 37 of the lock arm 32 of the first housing 10, whereby the torsion spring 90 is arranged in a state substantially positioned on the housing main body 11 toward the center axis of the first housing 10. Thus, the resilient arms 61 are not deflected or deformed inadvertently, thereby avoiding a situation where the detector 60 accidentally moves forward or backward from the standby position.

Figure 2:
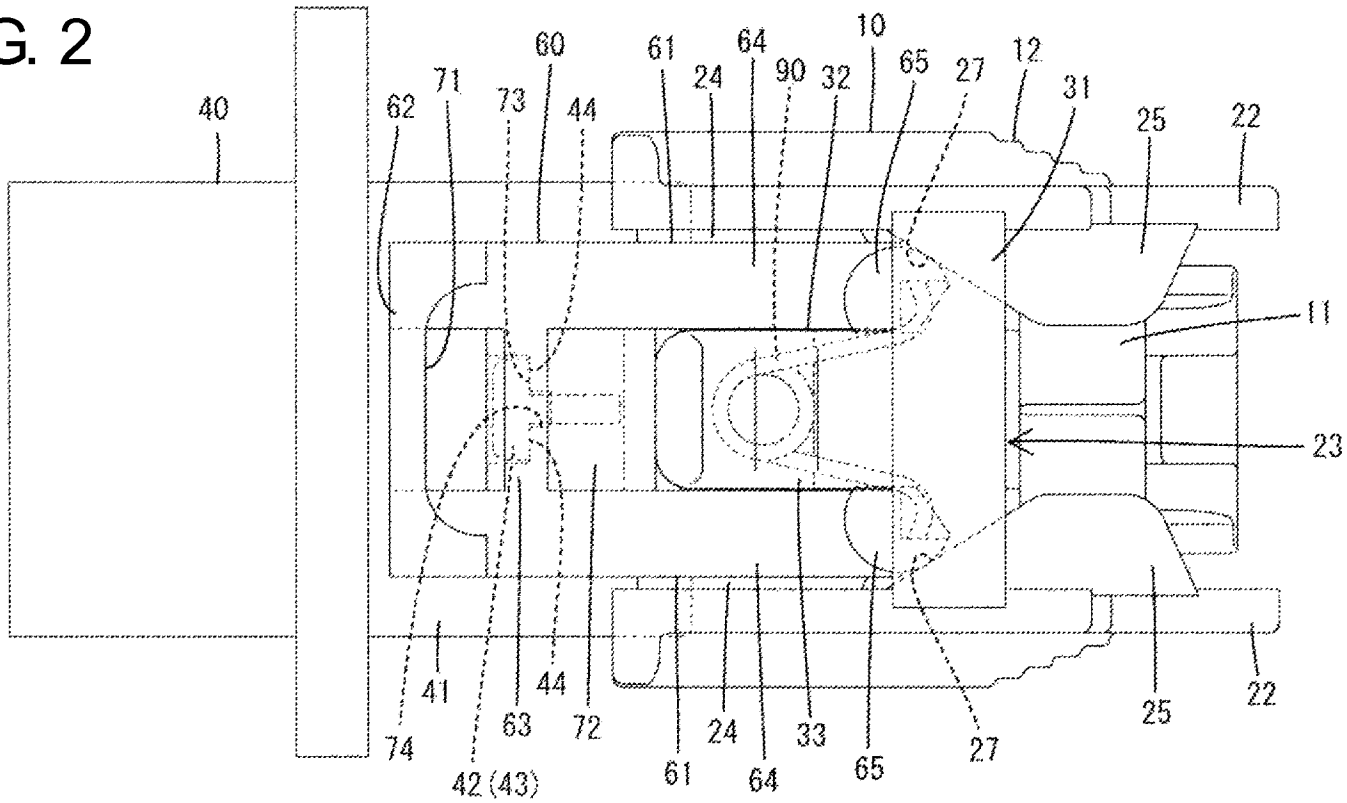
FIG. 2 is a plan view showing a state immediately before the first housing is lightly fit to a second housing and the detector starts moving toward a detection position.
Figure 6:
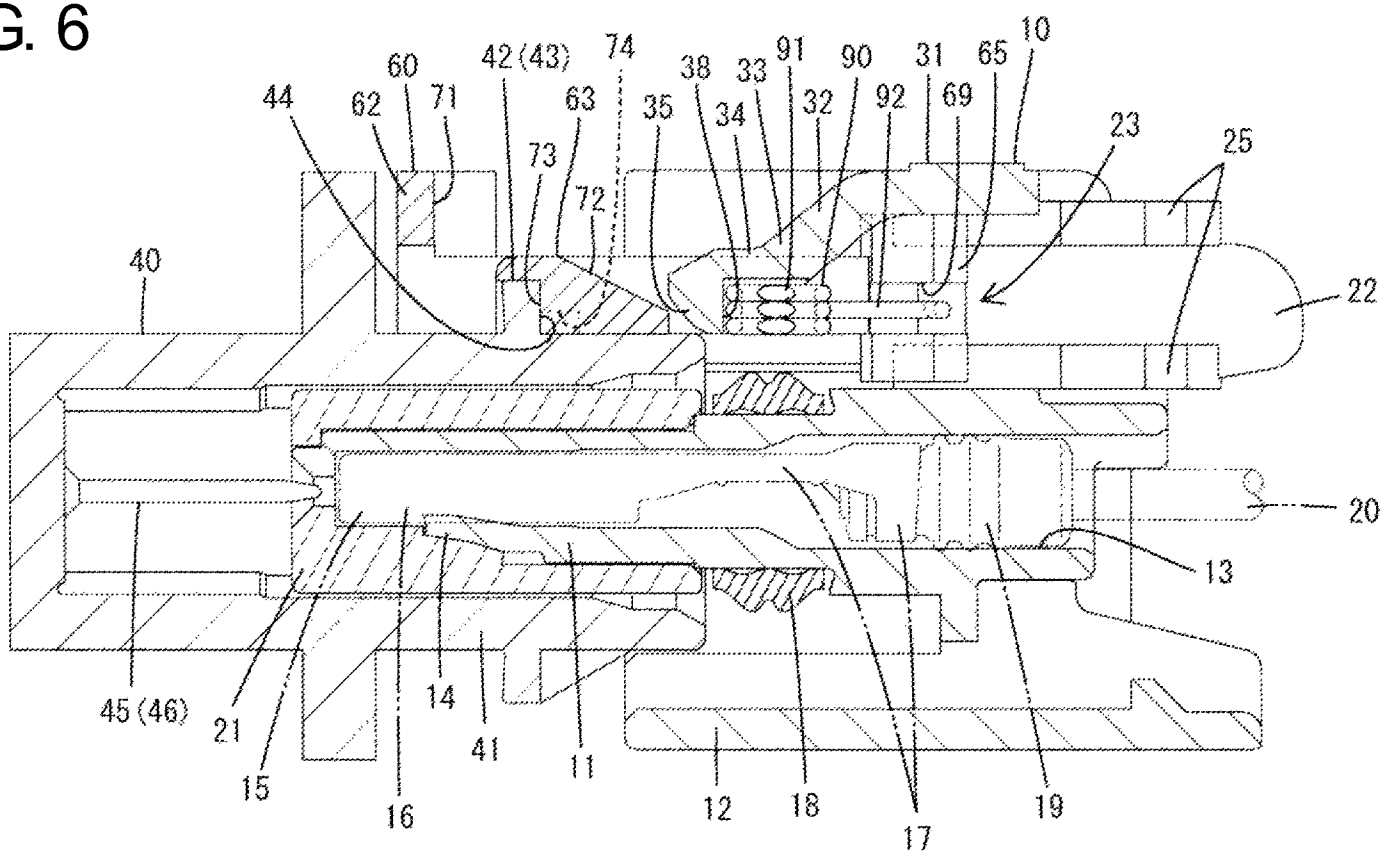
FIG. 6 is a side view in section showing a state of FIG. 2.
Figure 7:
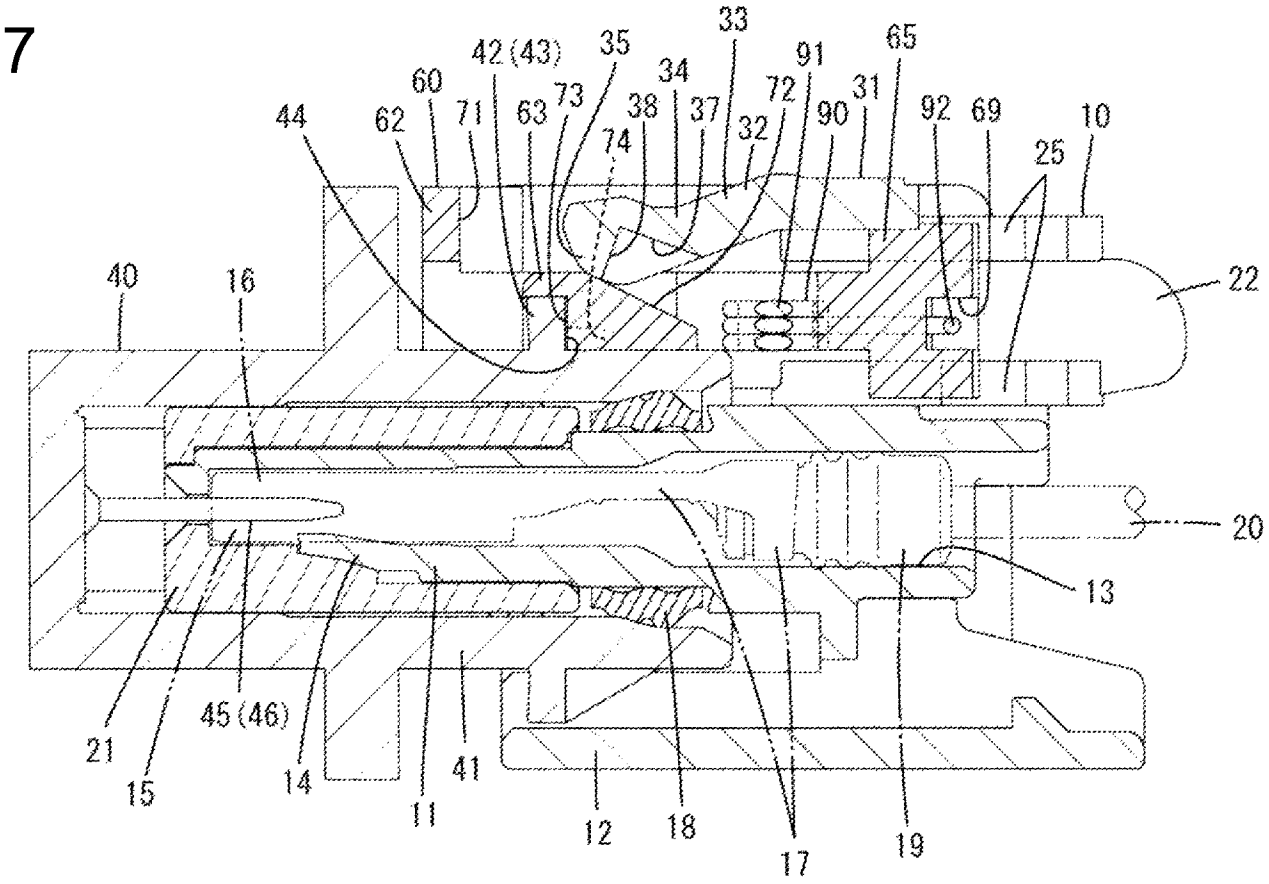
FIG. 7 is a side view in section showing a state of FIG. 3.

Subsequently, the housing main body 11 of the first housing 10 is fit lightly into the receptacle 41 of the second housing 40. Thus, the standing wall 43 and the guide wall 47 of the lock 42 are fit into the recess 73 and the deep recess 74 of the detector 60. As the housing main body 11 is fit farther, the pressing areas 44 of the standing wall 43 press opposite widthwise end parts of the back surface of the recess 73 and the detector 60 is moved smoothly back toward the detection position as shown in FIGS. 2 and 6. During this time, as shown in FIG. 7, the lock projection 35 of the lock arm 32 slides on the guiding slant 72 of the engaging portion 63 and the lock piece 33 is deflected and deformed up so that the coil 91 of the torsion spring 90 comes out of the fitting recess 37 of the lock arm 32.

Figure 3:
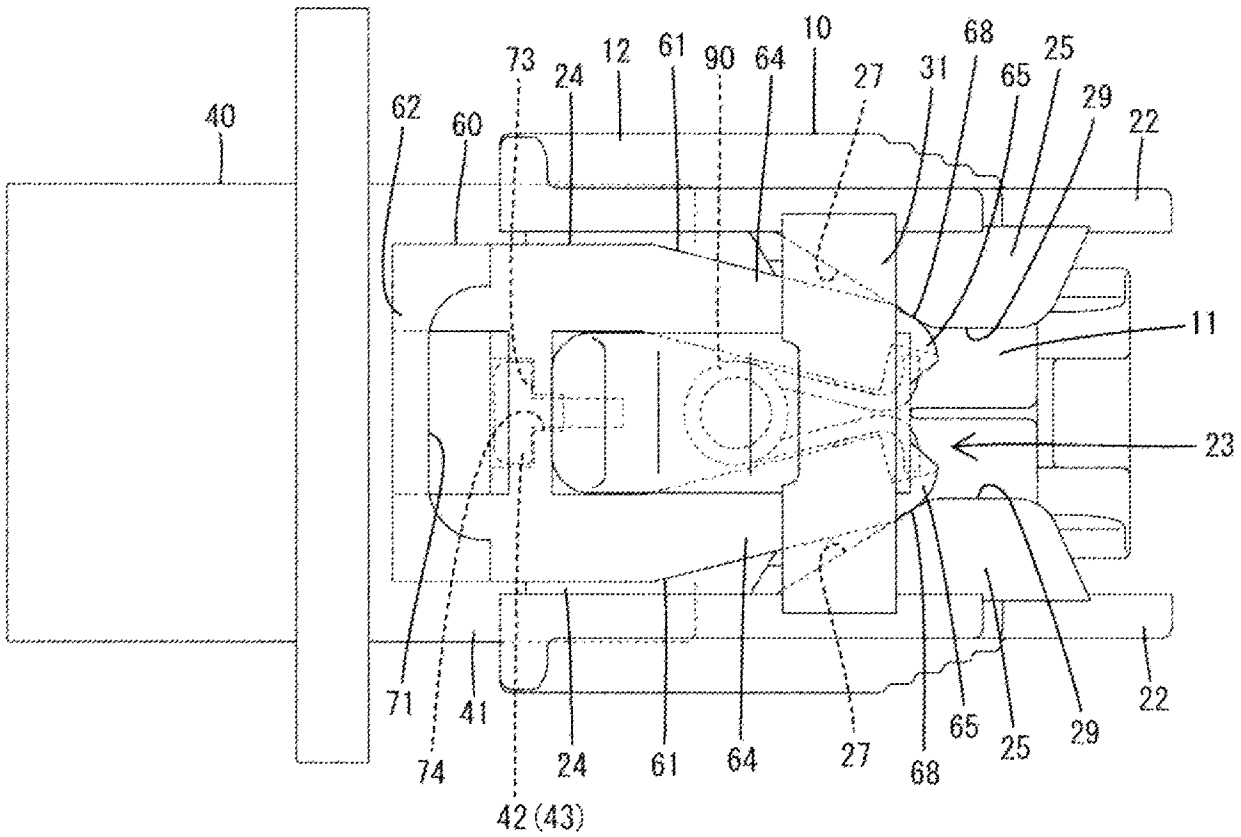
FIG. 3 is a plan view showing a state where the first housing is fit deeply to the second housing and both resilient arms of the detector are deflected and deformed.

The curved surfaces 68 of the sliding portions 65 slide back on the slants 27 of the guiding portions 25 when the detector 60 is moved back toward the detection position, as shown in FIGS. 3 and 10. Thus, the arm main bodies 64 are deflected and deformed inward to approach each other. The spring ends 92 of the torsion spring 90 also are deflected and deformed to approach each other as the arm main bodies 64 are deflected and deformed. Note that deflection directions of the arm main bodies 64 and the spring ends 92 of the torsion spring 90 intersect the connecting direction of the first and second housings 10, 40 (also a moving direction of the detector 60). This deflection and deformation of the resilient arms 61 and the spring ends 92 of the torsion spring 90 accumulates reaction forces of the resilient arms 61 and the torsion spring 90 and applies separation forces to the second housing 40 for pushing the second housing 40 away from the first housing 10. That is, the resilient arms 61 and the torsion spring 90 function as a reaction force generation means for separating the second housing 40 from the first housing 10.

The connecting operation of the first and second housings 10, 40 may be stopped halfway. In this case, the curved surfaces 68 of the sliding portions 65 slide forward on the slants 27 of the guiding portions 25 and the arm main bodies 64 and the both spring ends 92 of the torsion spring 90 displace resiliently away from each other in return directions. Displacement of the arm main bodies 64 away from each other causes the engaging portion 63 to push the pressing areas of the standing wall 43 back so that the second housing 40 is separated from the first housing 10. As a result, the first and second housings 10, 40 are not left in an incompletely connected state. Furthermore the resilient arms are unitary parts of the detector 60 and the detector 60 does not require a complex spring accommodating portion for accommodating coil springs as in the prior art. Thus, the structure of the detector 60 is less complicated than the prior art.

Figure 4:
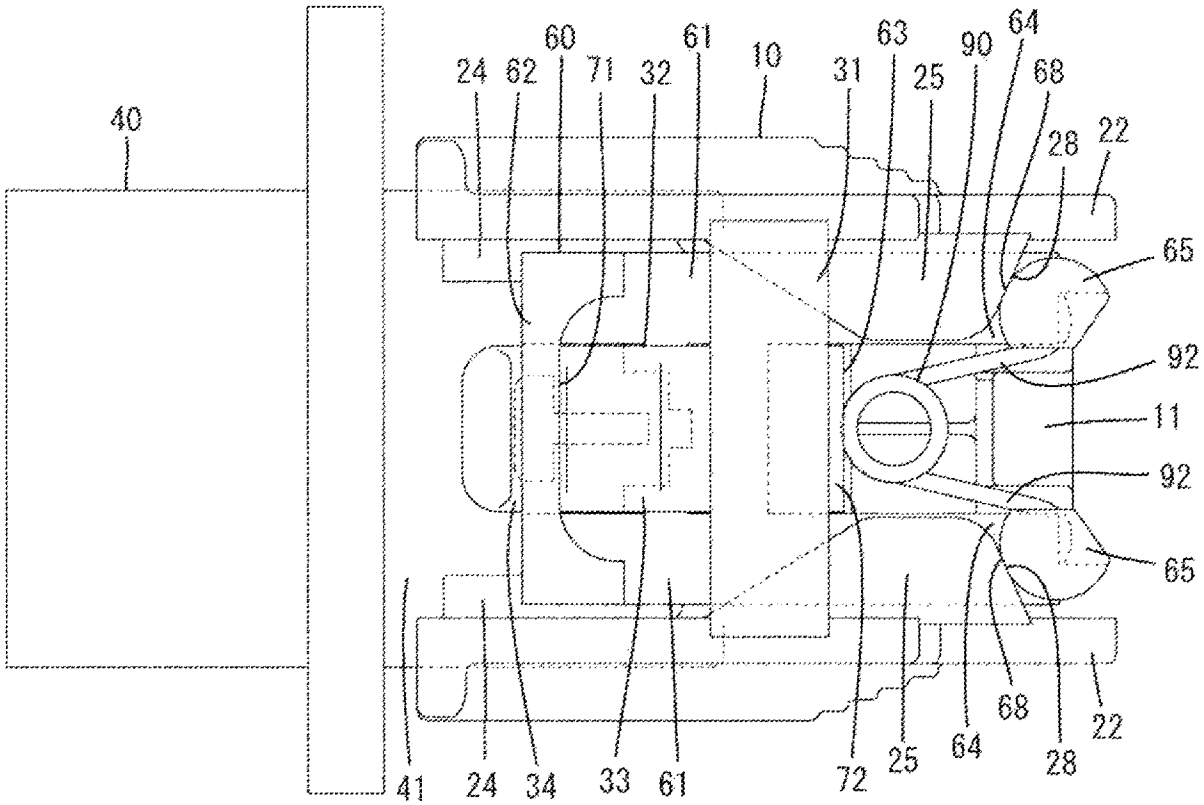
FIG. 4 is a plan view showing a state where the first housing is connected properly to the second housing and the detector is at the detection position.

On the other hand, if the connecting operation of the first and second housings 10, 40 proceeds without being interrupted, the curved surfaces 68 of the sliding portions 65 slide on the rear slants 28 beyond the straight surfaces 29 of the guiding portions 25. The resilient arms 61 and the spring ends 92 of the torsion spring 90 are widened away from each other while the sliding portions 65 slide on the rear slants 28. Thus, the connecting operation of the first and second housings 10, 40 proceeds automatically. The resilient arms 61 and the spring end portions 92 of the torsion spring 90 restore resiliently to a natural state when the sliding portions 65 reach positions behind the guiding portions 25, as shown in FIG. 4. At this time, as shown in FIG. 8, the arm main bodies 64 of the resilient arms 61 are fit into clearances between the guiding portions 25 arranged one above the other. Thus, the guiding portions 25 do not obstruct returning movements of the resilient arms 61. In this way, the detector 60 is brought to the detection position. Note that a moving posture of the detector 60 and the posture thereof after the movement are maintained stably by fitting the guide ribs 24 of the first housing 10 into the guide grooves 66 of the detector 60.

When the detector 60 reaches the detection position, as shown in FIG. 8, the lock projection 35 of the lock arm 32 moves over the upper surface of the engaging portion 63 and the lock piece 33 is restored resiliently to an original state. As the lock piece 33 is restored, the lock receiving surface 38 of the lock projection 35 of the lock arm 32 faces the locking area 48 of the standing wall 43. In this way, the first and second housings 10, 40 are held in a connected state. Further, when the detector 60 reaches the detection position, the regulating portion 62 is able to contact the lock piece 33 and covers the front end 34 of the lock piece 33 of the lock arm 32 from above. In this way, the lock arm 32 is prevented from being deflected and deformed up in a direction to release a locked state to the lock 42. At the detection position, an inclined part of the lock piece 33 behind the front end 34 escapes into the escaping recess 71 of the regulating portion 62.

The resilient arms 61 are deflected in directions intersecting the connecting direction during the connection of the first and second housings 10, 40 and apply separation forces to the second housing 40 if the connecting operation is stopped halfway for causing the second housing 40 to be separated from the first housing 10. Thus, the first and second housings 10, 40 are not left in an incompletely connected state. The resilient arms 61 are unitary with the detector 60 and the detector 60 is not provided with a spring accommodating portion for accommodating a spring. Thus, the structure of the detector 60 is simplified.

The slants 27 are provided in the first housing 10 and function as guiding surfaces for guiding the deflection of the resilient arms 61. Thus, the structure of the second housing 40 is prevented from becoming complicated. Further, the resilient arms 61 slide on the slants 27 to deflect and deform inward of the first housing 10. Thus, the deflected resilient arms 61 do not protrude out of the first housing 10 and will not interfere with external matter.

The regulating portion 62 contacts the lock arm 32 when the first and second housings 10, 40 are connected properly. Thus, the lock arm 32 cannot be released inadvertently from the locked state to the lock 42.

Two resilient arms 61 are provided at a distance from each other and the torsion spring 90 for assisting the separation forces by the resilient arms 61 by being pressed and resiliently deformed by the resilient arms 61 is provided between the resilient arms 61. Thus, the separation forces for separating the second housing 40 from the first housing 10 can be increased as compared with the case where only the resilient arms 61 are provided. As a result, reliability in detecting the incompletely connected state of the first and second housings 10, 40 is improved.

The resilient member is formed by the existing single torsion spring 90, so that versatility is excellent. Further, cost can be suppressed and parts management can be facilitated because it is not necessary to prepare a plurality of torsion springs 90. In addition, the single torsion spring 90 is provided between the resilient arms 61. Thus, separation forces by the resilient arm portions 61 are applied equally to the second housing 40 in a well-balanced manner.

The torsion spring 90 is arranged between the lock piece 33 and the housing main body 11 when the detector 60 is at the standby position. Thus, a dead space between the lock piece 33 and the housing main body 11 is utilized effectively as an arrangement area for the torsion spring 90 and the first housing 10 can be miniaturized.

Further, the pressing areas 44 on the front surface of the standing wall 43 of the lock portion 42 and the standing wall 43 has an additional function of pressing the detecting member 60. Thus, it is not necessary to provide a dedicated rib or the like for pressing the detecting member 60 and an existing male connector housing can be used as it is as the second housing 40. As a result, the versatility of the connector is improved.

The pressing areas 44 are at the opposite sides of the guide wall 47 on the front surface of the standing wall 43. Thus, the detector 60 pressed by the both pressing areas 44 can be moved toward the detection position in a well-balanced manner.

The recess 73 is provided in the widthwise central part of the front end of the detector 60, and the standing wall 43 is fit into the recess 73 and the pressing areas 44 contact the back surface of the recess 73 when the detector 60 is moved in the process of the connecting the first and second housings 10, 40. Thus, the detector 60 can be moved toward the detection position in a better-balanced manner without being displaced between the pressing areas 44.

Two resilient arms 61 are provided at a distance from each other and the torsion spring 90 as a resilient member is provided between the resilient arms 61 for assisting the separation forces by the resilient arms 61 by being pressed and resiliently deformed by the both resilient arms 61. Thus, the separation force for separating the second housing 40 from the first housing 10 is increased as compared with the case where only the resilient arms 61 are provided. As a result, reliability in detecting the incompletely connected state of the first and second housings 10, 40 can be further improved.

Other embodiments are briefly described below.

If the resilient arms have a sufficiently high reaction force, the torsion spring as the resilient member can be omitted. That is, the reaction force generation means may be composed only of the resilient arms.

The resilient member may be another spring such as a leaf spring or a resiliently deformable cushion member.

The detector may move the first housing forward toward the detection position. In this case, the detector may be biased by the reaction force generation means and pushed back to the standby position again after being temporarily moved back from the standby position.

The slants as the guiding surfaces may be provided in the second housing.

The resilient arms may be deflected and deformed outwardly of the first housing along the slants.

The detector may be arranged between the housing main body and the lock piece also after reaching the detection position.

REFERENCE SIGNS

10 . . . first housing
11 . . . housing main body
27 . . . slant
32 . . . lock arm
33 . . . lock piece
40 . . . second housing
41 . . . receptacle
42 . . . lock
43 . . . standing wall
44 . . . pressing area
47 . . . guide wall
48 . . . locking area
60 . . . detector
61 . . . resilient arm
62 . . . regulating portion
63 . . . engaging portion
73 . . . recess
90 . . . torsion spring (resilient member)

What is claimed is:

1. A connector, comprising:

a first housing including a lock arm with a lock piece having a forward facing front end and a rearward facing lock receiving surface;

a second housing connectable to the first housing and including at least one lock, the lock being locked to the lock arm to hold the first and second housings in a properly connected state; and at least one detector movably mounted on the first housing, the detector having a forward facing surface configured to being pressed and moved by the second housing in the process of connecting the first and second housings and a rearward facing tapered guide slant disposed and configured to engage the forward facing front end of the lock piece to generate deflection of the lock arm when the first and second housings are being connected, wherein:

the lock of the second housing includes at least one standing wall extending along a direction intersecting a connecting direction of the first and second housings; and a locking area provided on a rear surface surface of the standing wall and being locked by the rearward facing lock receiving surface of the lock arm when the first and second housings are connected properly and a pressing area provided on a front surface of the standing wall for pressing the detector when connecting the first and second housings.

2. The connector of claim 1, further comprising a reaction force generation member provided in or on the detector and exerting forces to separate the second housing from the first housing when a connecting operation of the first and second housings is stopped at an intermediate stage.

3. The connector of claim 2, wherein the reaction force generation member comprises a resilient member configured to assist separation forces of the first and second housings.

4. The connector of claim 3, wherein the first housing includes a housing main body configured to define a deflection space for the lock arm between a lock piece of the lock arm and the housing main body, and the resilient member being between the lock piece and the housing main body at least before the detector is moved.

5. The connector of claim 1, wherein the lock includes at least one guide wall projecting from the front surface of the standing wall and two of the pressing areas are arranged at substantially opposite sides of the guide wall on the front surface of the standing wall.

6. The connector of claim 1, further comprising a recess provided in an intermediate part of the detector in a width direction perpendicular to a moving direction of the detector.

7. The connector of claim 6, wherein the standing wall is fit into the recess and wherein the pressing area contacts a back surface of the recess when the detector is moved while connecting the first and second housings.

8. The connector of claim 1, wherein the detector includes at least one regulating portion configured to regulate the deflection of the lock arm in a direction to release a locked state to the second housing by contacting the lock arm when the first and second housings are connected properly.

9. A connector, comprising:

a first housing including a lock arm;

a second housing connectable to the first housing and including at least one lock, the lock being locked to the lock arm to hold the first and second housings in a properly connected state; and at least one detector movably mounted on the first housing, the detector being configured to being pressed and moved by the second housing in the process of connecting the first and second housings, a resilient arm unitary with the detector and being deflected in a direction intersecting a connecting direction of the first and second housings when connecting the first and second housings, the resilient arm applying a separation force between the first and second housings in a direction to separate the first and second housings from each other by sliding on at least one guiding surface on one of the first and second housings, wherein:

the lock includes at least one standing wall extending along a direction intersecting a connecting direction of the first and second housings; and a locking area provided on one wall surface of the standing wall and being locked by the lock arm when the first and second housings are connected properly and a pressing area provided on another wall surface of the standing wall for pressing the detector when connecting the first and second housings.

10. The connector of claim 9, wherein the guiding surface is a slant in the first housing aligned for deflecting the resilient arm inward of the first housing.

11. The connector of claim 9, further comprising a reaction force generation member provided in or on the detector and exerting forces to separate the second housing from the first housing when a connecting operation of the first and second housings is stopped at an intermediate stage.

12. The connector of claim 11, wherein the reaction force generation member comprises a resilient member configured to assist separation forces of the first and second housings.

13. The connector of claim 9, wherein the first housing includes a housing main body configured to define a deflection space for the lock arm between a lock piece of the lock arm and the housing main body, and the resilient member being between the lock piece and the housing main body at least before the detector is moved.

* * * * *